US005326100A

United States Patent [19]

Chen

[11] Patent Number: 5,326,100

[45] Date of Patent: Jul. 5, 1994

[54] CROQUET MALLET WITH FOAM OR CUSHION OUTER LAYER

[76] Inventor: Chiu-Yuan Chen, No. 146, Shan Ying Road, Kuei Shan Hsiang, Taoyuan Hsien, Taiwan

[21] Appl. No.: 109,450

[22] Filed: Aug. 20, 1993

[51] Int. Cl.[5] ..... A63B 59/10

[52] U.S. Cl. ..... 273/83; 273/56; 273/167 C

[58] Field of Search ..... 273/56, 26 B, 67 R, 273/72 R, 83, 84 R, 167 C, 167 D; 446/1, 144

[56] References Cited

U.S. PATENT DOCUMENTS 2,097,459 11/1937 Hosier ..... 273/83
4,705,273 11/1987 Ament et al. ..... 273/72 R
5,219,163 6/1993 Watson ..... 273/67 R

*Primary Examiner*—Jessica J. Harrison
*Assistant Examiner*—William M. Pierce

[57] ABSTRACT

A toy croquet mallet composed of a handle portion and a striking head portion detachably connected to the handle portion by means of threads, wherein the striking head portion has a cylindrical main body formed with a plurality of recesses and wrapped by a relatively supple protective layer, whereby the safety in playing the croquet game can be insured and the croquet mallet can be disassembled for easy storage.

2 Claims, 3 Drawing Sheets

CROQUET MALLET WITH FOAM OR CUSHION OUTER LAYER

BACKGROUND OF THE INVENTION

The present invention relates to a toy croquet mallet composed of a handle portion and a striking head portion detachably connected to the handle portion, wherein the striking head portion has a cylindrical main body having a plurality of recesses distributed on the surface thereof and wrapped by a relatively supple protective layer, whereby the safety in playing the croquet game can be insured and the weight of the croquet mallet is reduced, permitting the croquet mallet to be more easily controlled to avoid accidental injury to the player caused by unexpected striking of the mallet. Moreover, the corquet mallet can be disassembled for easy storage.

One of the most popular sport games enjoyed by children is toy croquet, wherein a substantially reverse T-shaped iron club is gripped and aimed at a ball placed on the ground and then the club is swung to strike and roll the ball.

Such croquet mallet has the following shortcomings:

1. The croquet mallet is made of metal or wood and has a considerable weight so that a child often cannot easily grip and freely control the croquet mallet. Moreover, children tend to get injured when they try to swing an overweight croquet mallet.

2. Children are likely to improperly swing the solid metal-made or wood-made croquet mallet and unexpectedly hit and hurt the others. Therefore, the safety in playing the toy croquet cannot be insured.

3. The conventional croquet mallets are fixedly T-shaped and room-occupying and thus cannot be easily folded for storage.

It is therefore tried by the applicant to develop an improved toy croquet mallet to eliminate the above shortcomings existed in the conventional croquet mallets.

SUMMARY OF THE INVENTION

It is therefore a primary object of the present invention to provide an improved toy croquet mallet which is composed of a handle portion and a striking head portion detachably connected to the handle portion, wherein the striking head portion has a cylindrical main body wrapped by a relatively supple protective layer, whereby the safety in playing the croquet game can be insured and the weight of the croquet mallet is reduced, permitting the croquet mallet to be more easily controlled to avoid accidental injury to the player caused by unexpected striking. Moreover, the corquet mallet can be disassembled for easy storage.

It is a further object of the present invention to provide the above toy croquet mallet, wherein the periphery of a main body of the striking head portion is formed with a plurality of recesses distributed on the surface thereof which increase the contact area of the protective layer on the main body so as to more securely associate the protective layer with the main body.

BRIEF DESCRIPTION OF THE DRAWINGS

The structure, features, functions, and other objects of the present invention, and the technical means adopted to achieve the present invention can be best understood through the following detailed description of the preferred embodiment and the accompanying drawings wherein.

DETAILED DESCRIPTION OF THE PREFERRED EMBODIMENT

Figure 1:
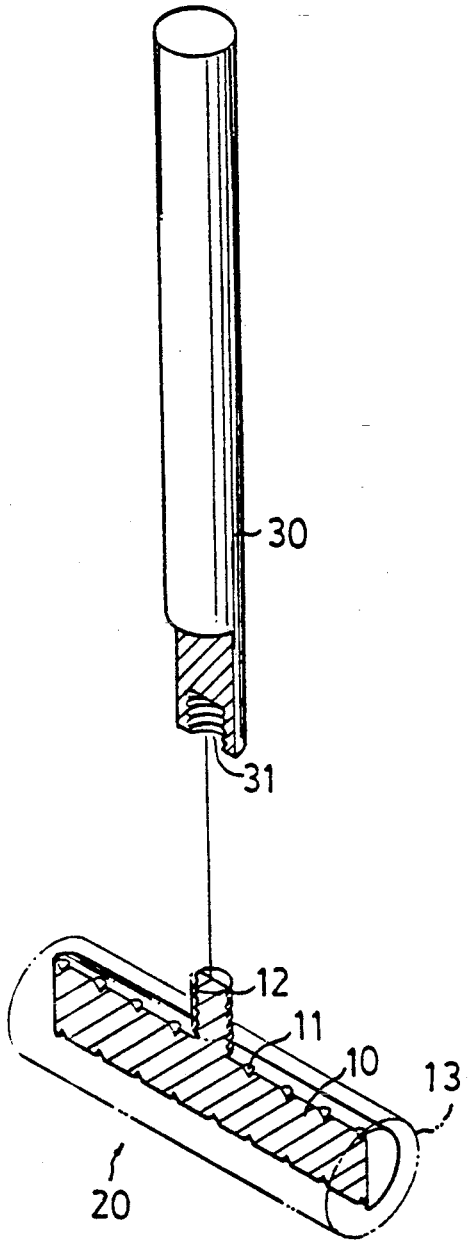
FIG. 1 is a perspective exploded view of the present invention.
Figure 2:
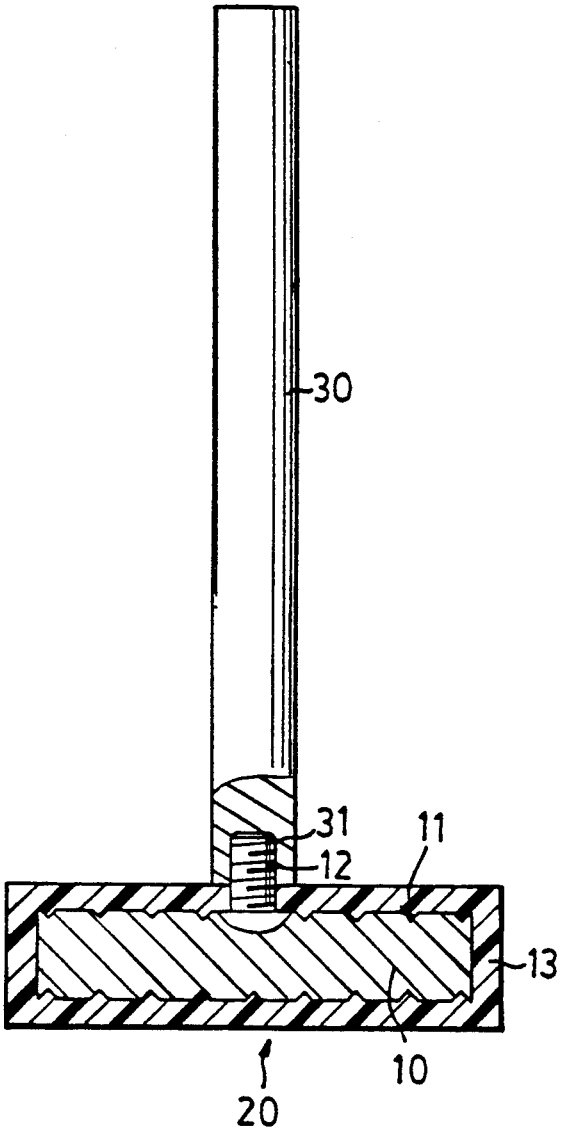
FIG. 2 is a partial sectional view of the present invention showing the connection of the handle portion to the striking head portion.
Figure 3:
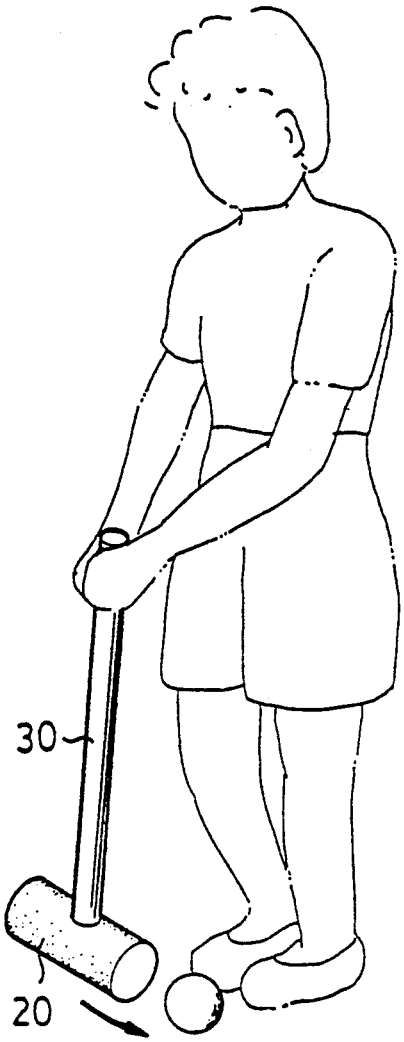
FIG. 3 illustrates the application of the present invention.

Please refer to FIGS. 1 and 2. The croquet mallet of the present invention is composed of a handle portion 30 and a striking head portion 20, wherein the handle portion 30 has a lower connecting section 31 which has an internally threaded bore, and the striking head portion 20 includes a cylindrical main body 10 and a central connecting boss 12 formed with outer threads and projecting upward from the main body 10. On the peripheral surface of the main body 10, a plurality of recesses 11 are formed so that the main body 10 can be tightly wrapped by a foamed protective layer 13 covered on the surface of the main body 10 by means of integral injection molding. The connecting boss 12 of the striking head portion 20 can be screwed into the connecting section 31 of the handle portion 30 as shown in FIGS. 2 and 3.

The above arrangements of the croquet mallet are simple but have following advantages over the conventional one:

1. Insured safety: The striking head portion 20 is wrapped by the protective layer 13 which is relatively supple and prevents the striking head portion 20 from any rigid surface, burred edge and sharp corner so that when the striking head portion 20 strikes a ball, the striking force is effectively buffered. In addition, in the event a child is unexpectedly hit by the striking head portion 20, the harm to the child can be greatly reduced so that the safety of children in playing the croquet game can be insured.

2. Less room occupied: Because the handle portion 30 and the striking head portion 20 are detachably assembled, they can be disassembled and separately stored when they are not in use so that the room for storing the croquet mallet can be effectively reduced.

3. Less weight: The striking head portion 20 wrapped by the protective layer 13 is lighter than an otherwise entirely solid striking head. Therefore, the striking movement can be more steadily and easily controlled and thus the sport injury resulting from hard action can be prevented.

4. Firm structure: The periphery of the main body 10 is formed with a plurality of recesses 11 which increase the contact area of the protective layer 13 on the main body 10 and thus more securely associate the protective layer 13 with the main body 10.

It is to be understood that the above description and drawings are only used for illustrating one embodiment of the present invention, not intended to limit the scope of the present invention. Any variation and derivation from the above description and drawings should be included in the scope of the present invention.

What is claimed is:

1. A toy croquet mallet comprising a handle portion and a striking head portion; said handle portion having a lower connecting section with a means for detachably engaging with said striking head portion; said striking head portion has a cylindrical main body and a connecting boss projecting from a central portion of said main body; said main body having a plurality of recesses formed on a peripheral surface thereof and being wrapped by a relatively supple protective layer to insure safety in playing croquet game, and said recesses distributed on the surface of said main body increasing contact area of said protective layer on said periphery of said main body and thus more securely associating said protective layer with said main body.

2. A toy croquet mallet as claimed in claim 1, wherein said connecting section of said handle portion has an internally threaded bore and is engaged with said connecting boss of said striking head portion by screwing said connecting boss into said threaded bore of said connection section of said handle portion.

* * * * *